US007142174B2

(12) United States Patent
Honda et al.

(10) Patent No.: US 7,142,174 B2
(45) Date of Patent: Nov. 28, 2006

(54) DRIVING METHOD OF PLASMA DISPLAY PANEL

(75) Inventors: Hirofumi Honda, Yamanashi (JP); Tetsuya Shigeta, Yamanashi (JP); Tetsuro Nagakubo, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 90 days.

(21) Appl. No.: 09/883,448

(22) Filed: Jun. 19, 2001

(65) Prior Publication Data

US 2002/0015011 A1 Feb. 7, 2002

(30) Foreign Application Priority Data

Jun. 21, 2000 (JP) ..... 2000-186530

(51) Int. Cl.
*G09G 3/28* (2006.01)

(52) U.S. Cl. ..... 345/63; 345/60

(58) Field of Classification Search ..... 345/62, 345/596, 63, 60

See application file for complete search history.

(56) References Cited

U.S. PATENT DOCUMENTS 5,757,343 A * 5/1998 Nagakubo ..... 345/63
6,091,396 A * 7/2000 Minami et al. ..... 345/690
6,094,187 A * 7/2000 Jones et al. ..... 345/690
6,222,512 B1 * 4/2001 Tajima et al. ..... 345/63
6,333,766 B1 * 12/2001 Kougami et al. ..... 348/687
6,646,625 B1 * 11/2003 Shigeta et al. ..... 345/63

* cited by examiner

*Primary Examiner*—Sumati Lefkowitz
*Assistant Examiner*—Ke Xiao
(74) *Attorney, Agent, or Firm*—Sughrue Mion, PLLC

(57) ABSTRACT

A driving method of a plasma display panel capable of executing a dither processing without lowering display quality. When only discharge cells set to a light emission cell state in accordance with input image signals are allowed to emit light a predetermined number of light emissions allotted in accordance with weighting of sub-fields, the number of light emissions to be allotted is rendered different for each discharge cell inside a discharge cell block.

3 Claims, 15 Drawing Sheets

FIG.5

[SELECTIVE ERASE]

| GRADATION | CONVERSION TABLE OF SECOND DATA CONVERSION CIRCUIT 34 | | | | | LIGHT EMISSION DRIVING PATTERN | | | | LUMINANCE | | | |
|---|---|---|---|---|---|---|---|---|---|---|---|---|---|
| | PDL | GD 1 | GD 2 | GD 3 | GD 4 | SF 1 | SF 2 | SF 3 | SF 4 | A | B | C | D |
| 1 | 000 | 1 | 1 | 1 | 1 | ● | ● | ● | ● | 0 | 0 | 0 | 0 |
| 2 | 001 | 0 | 1 | 1 | 1 | ○ | ● | ● | ● | 20 | 28 | 12 | 4 |
| 3 | 010 | 0 | 0 | 1 | 1 | ○ | ○ | ● | ● | 72 | 88 | 56 | 40 |
| 4 | 011 | 0 | 0 | 0 | 1 | ○ | ○ | ○ | ● | 156 | 180 | 132 | 108 |
| 5 | 100 | 0 | 0 | 0 | 0 | ○ | ○ | ○ | ○ | 272 | | 240 | 208 |

BLACK CIRCLE : SELECTIVE ERASE DISCHARGE (LIGHT NON-EMISSION)
WHITE CIRCLE : SUSTAIN DISCHARGE (LIGHT EMISSION)

FIG. 9

| (ROW) \ (COLUMN) | 1 | 2 | 3 | 4 | ....(COLUMN) |
|---|---|---|---|---|---|
| 1 | A | B | A | B | |
| 2 | C | D | C | D | |
| 3 | A | B | A | B | |
| 4 | C | D | C | D | |
| ⋮ | | | | | |

FIG. 15

[SELECTIVE WRITE]

| GRADATION | CONVERSION TABLE OF SECOND DATA CONVERSION CIRCUIT 34 | | | | | LIGHT EMISSION DRIVING PATTERN | | | | LUMINANCE | | | |
|---|---|---|---|---|---|---|---|---|---|---|---|---|---|
| | $PD_L$ | GD 1 | GD 2 | GD 3 | GD 4 | SF 1 | SF 2 | SF 3 | SF 4 | A | B | C | D |
| 1 | 000 | 0 | 0 | 0 | 0 | | | | | 0 | 0 | 0 | 0 |
| 2 | 001 | 1 | 0 | 0 | 0 | ◎ | | | | 20 | 28 | 12 | 4 |
| 3 | 010 | 1 | 1 | 0 | 0 | ◎ | ◎ | | | 72 | 88 | 56 | 40 |
| 4 | 011 | 1 | 1 | 1 | 0 | ◎ | ◎ | ◎ | | 156 | 180 | 132 | 108 |
| 5 | 100 | 1 | 1 | 1 | 1 | ◎ | ◎ | ◎ | ◎ | 272 | | 240 | 208 |

DRIVING METHOD OF PLASMA DISPLAY PANEL

BACKGROUND OF THE INVENTION

1. Field of the Invention

This invention relates to a driving method of a matrix display system plasma display panel.

2. Description of Related Art

An AC (alternating current discharge) type plasma display is known as one of display panels of a matrix display scheme.

Such a plasma display panel includes a plurality of row electrodes each bearing a role of a display line, and a plurality of column electrodes so arranged respectively as to intersect the row electrodes. These row and column electrodes are arranged in such a way as to oppose one another while interposing therebetween a discharge space filled with a discharge gas. Discharge cells serving as pixels are formed at the points of intersection between a row electrode pair and the column electrodes inclusive of the discharge space. Since the discharge cell emits light by utilizing a discharge phenomenon, it can assume only two states, that is, a "light emission" state and a "light non-emission" state. In other words, this plasma display device can express luminance of only two gradations, i.e., the lowest luminance (light non-emission state) and the highest luminance (light emission state). Therefore, gradation driving using a sub-field method is executed in order to accomplish luminance display of an intermediate tone corresponding to input image signals for the plasma display panel comprising such discharge cells.

In the driving system using the sub-field method, a display period of one field (frame) is constituted by a plurality of sub-fields. In each sub-field, each of discharge cells is set to either a "light emission cell" state or a "light non-emission cell" state in accordance with pixel data for each pixel on the basis of an input image signal. Only the discharge cell under the "light emission cell" state is allowed to discharge (with light emission) a number of times (for a time) corresponding to weighting of its sub-field, for each sub-field. In this instance, various intermediate luminance can be visually sensed stepwise in accordance with the sum of the number of light emissions made inside the one-field (frame) display period.

In recent years, display apparatus having the plasma display panel mounted thereto have contemplated to increase the number of gradations by combining gradation driving using the sub-field method described above with a multi-gradation processing such as a dither processing.

In such a dither processing, four discharge cells, for example, that are adjacent to one another among the discharge cells arranged in a matrix form are grasped as one discharge cell block. Sequentially, four dither coeffients having different values each are allotted to each of the four discharge cells inside the discharge cell block. Here, a dither coefficient allotted as described above is added to each pixel data corresponding to each discharge cell inside the discharge cell block. Only the high-order bit of the addition result is grasped as new pixel data, and gradation driving described above is executed. According to such a dither processing, new intermediate luminance can be visually sensed depending on the combination of the light emission (or light non-emission) state of the four discharge cells inside the discharge cell block, and the number of gradations can be virtually increased.

According to the multi-gradation method described above, however, a process for adding the dither coefficient to the pixel data is necessary. Therefore, a luminance difference between the adjacent discharge cells greatly fluctuates depending on the value of original pixel data with the result that display quality is likely to drop, too.

SUMMARY OF THE INVENTION

In view of the problems described above, the present invention aims at providing a driving method of a plasma display panel capable of executing a dither processing without lowering display quality.

In a driving method of a plasma display panel for driving gradation-wise a plasma display panel having a plurality of discharge cells each arranged in matrix and bearing a role of a pixel by constituting one field of input image signals by a plurality of sub-fields, a driving method of a plasma display panel according to the present invention is characterized in that when each of the discharge cells is set to a light emission cell state or a light non-emission cell state in accordance with the input image signal in each of the sub-fields and only the discharge cell under the light emission cell state is caused to emit light the number of light emissions allotted in accordance with weighting of the sub-field, while the number of light emissions to be allotted in accordance with weighting of the sub-field is rendered different for each of the discharge cells inside a discharge cell block consisting of a plurality of discharge cells adjacent to one another.

BRIEF DESCRIPTION OF THE DRAWINGS

FIG. 5 is a data conversion table by a second data conversion circuit 34 and a light emission driving pattern inside one-field display period;

FIG. 9 shows correspondence between a discharge cell block and a light emission driving format allocated to each discharge cell inside the discharge cell block;

FIG. 15 is a data conversion table used in a second data conversion circuit 34 and a light emission driving pattern in one-field display period when a selective write address method is employed.

DESCRIPTION OF THE PREFERRED EMBODIMENTS

Hereinafter, preferred embodiments of the present invention will be explained with reference to the drawings.

Figure 1:
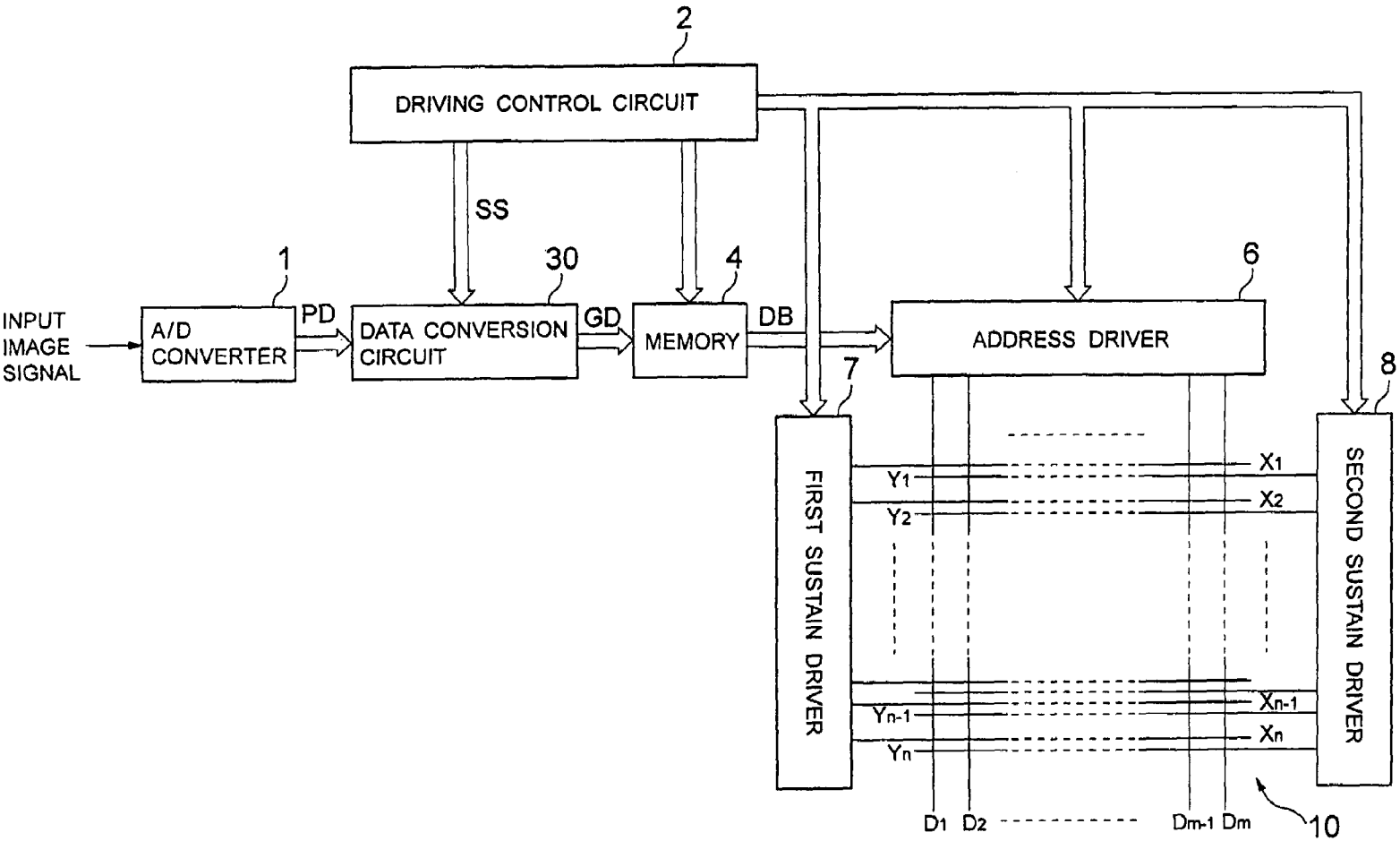
FIG. 1 is a schematic diagram showing the construction of a plasma display device for driving a plasma display panel based on an intermediate gradation display method according to the present invention.

FIG. 1 shows a schematic construction of a plasma display device for driving gradation-wise a plasma display panel in accordance with a driving method of the present invention.

Referring to FIG. 1, a PDP 10 as a plasma display panel is shown equipped with m column electrodes $D_1$ to $D_m$, and n row electrodes $X_1$ to $X_n$ and n row electrodes $Y_1$ to $Y_n$ so arranged as to cross the column electrodes, respectively. These row electrodes $X_1$ to $X_n$ and $Y_1$ to $Y_n$ bear first to nth display lines of the PDP 10 in the form of pairs of row electrodes $X_i(1 \leqq i \leqq n)$ and $Y_i(1 \leqq i \leqq n)$, respectively. A discharge space filled with a discharge gas is defined between the column electrode D and the row electrodes X and Y. A discharge cell as a pixel is formed at each intersection between each row electrode pair and each column electrode inclusive of this discharge space. In other words, (n×m) discharge cells corresponding to the first row/first column to nth row/mth column are formed in the PDP 10.

An A/D converter 1 samples an input analog image signal, converts the signal to 4-bit pixel data PD, for example, corresponding to each pixel and supplies this pixel data to a data conversion circuit 30.

Figure 2:
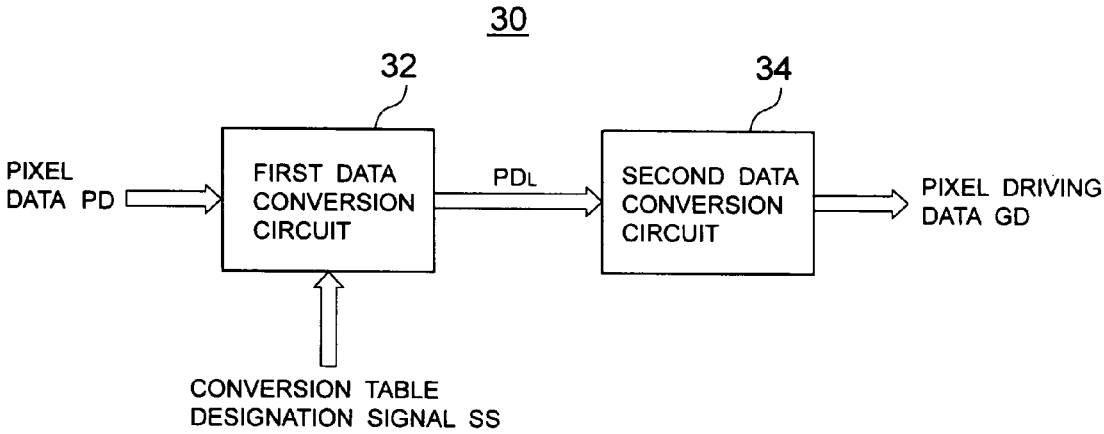
FIG. 2 is a diagram showing an internal construction of a data conversion circuit 30.

FIG. 2 shows an internal construction of such a data conversion circuit 30.

Referring to FIG. 2, a first data conversion circuit 32 converts the above-mentioned pixel data PD capable of expressing a luminance range of "0" to "15" by four bits to luminance suppression pixel data $PD_L$ in which luminance is suppressed to a luminance range of "0" to "4" by three bits.

Figure 3:
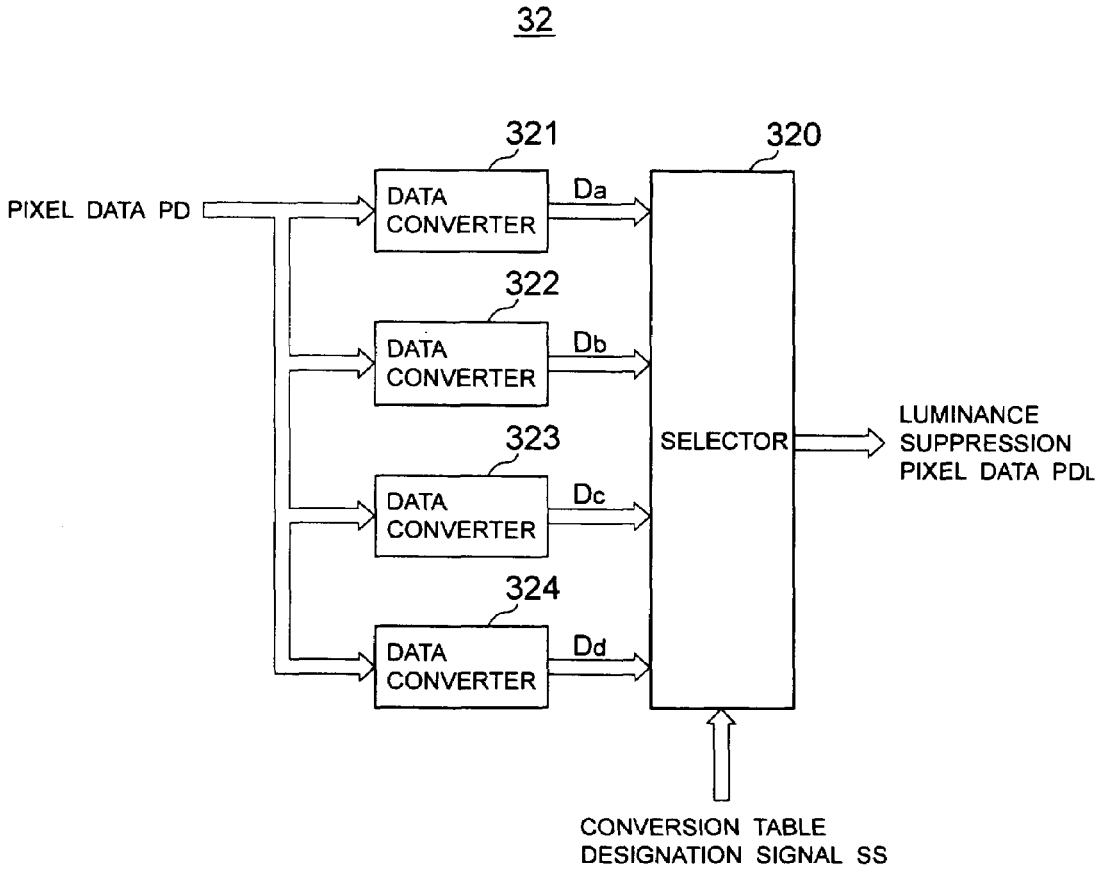
FIG. 3 is a diagram showing an internal construction of a first data conversion circuit 32 in the data conversion circuit 30.

FIG. 3 shows an internal construction of the first data conversion circuit 32 described above.

Figure 4A:
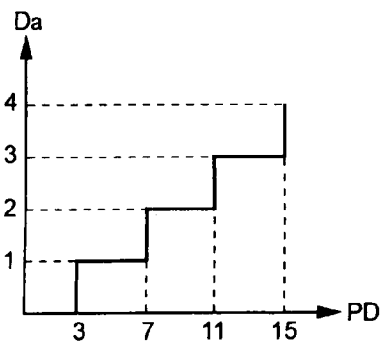
FIGS. 4A through 4D are diagrams showing first to fourth conversion tables by data converters 321 to 324, respectively.

Referring to FIG. 3, a data converter 321 converts the four-bit pixel data PD described above to three-bit converted pixel data Da in accordance with a first conversion table shown in FIG. 4A, and supplies this pixel data Da to a selector 320. A data converter 322 converts the four-bit pixel data PD described above to three-bit converted pixel data Db in accordance with a second conversion table shown in FIG. 4B, and supplies the pixel data Db to the selector 320. A data converter 323 converts the four-bit pixel data PD described above to three-bit converted pixel data Dc in accordance with a third conversion table shown in FIG. 4C, and supplies the pixel data Dc to the selector 320. A data converter 324 converts the four-bit pixel data PD described above to three-bit converted pixel data Dd in accordance with a fourth conversion table shown in FIG. 4D, and supplies the pixel data Dd to the selector 320. The selector 320 alternatively selects one of the converted pixel data Da to Dd designated by a conversion table designation signal SS and outputs the selected data as the luminance suppression pixel data $PD_L$. Incidentally, the conversion table designation signal SS is supplied from a driving control circuit 2. The driving control circuit 2 supplies to the selector 320 the conversion table designation signal SS, that is to selectively output the converted pixel data Da obtained by the first conversion table as the luminance suppression pixel data $PD_L$ for the pixel data PD corresponding to the discharge cell belonging to an odd-numbered row/odd-numbered column. The driving control circuit 2 supplies to the selector 320 the conversion table designation signal SS, that is to selectively output the converted pixel data Db obtained by the second conversion table as the luminance suppression pixel data $PD_L$, for the pixel data PD corresponding to the discharge cell belonging to an odd-numbered row/even-numbered column. The driving control circuit 2 supplies to the selector 320 the conversion table designation signal SS, that is to selectively output the converted pixel data Dc obtained by the third conversion table as the luminance suppression pixel data $PD_L$, for the pixel data PD corresponding to the discharge cell belonging to an even-numbered row/odd-numbered column. The driving control circuit 2 supplies to the selector 320 the conversion table designation signal SS, that is to selectively output the converted pixel data Dd obtained by the fourth conversion table as the luminance suppression pixel data $PD_L$, for the pixel data PD corresponding to the discharge cell belonging to an even-numbered row/even-numbered column.

In other words, when the pixel data PD corresponds to the discharge cell arranged in the odd-numbered row/odd-numbered column, the first data conversion circuit 32 converts this pixel data PD to three-bit luminance suppression pixel data $PD_L$ in accordance with the first conversion table shown in FIG. 4A. When the pixel data PD corresponds to the discharge cell arranged in the odd-numbered row/even-numbered column, the first data conversion circuit 32 converts this pixel data PD to three-bit luminance suppression pixel data $PD_L$ in accordance with the second conversion table shown in FIG. 4B. When the pixel data PD corresponds to the discharge cell arranged in the even-numbered row/odd-numbered column, the first data conversion circuit 32 converts this pixel data PD to three-bit luminance suppression pixel data $PD_L$ in accordance with the third conversion table shown in FIG. 4C. When the pixel data PD corresponds to the discharge cell arranged in the even-numbered row/even-numbered column, the first data conversion circuit 32 converts this pixel data PD to three-bit luminance suppression pixel data $PD_L$ in accordance with the fourth conversion table shown in FIG. 4D.

A second data conversion circuit 34 shown in FIG. 2 converts the luminance suppression data $PD_L$ to four-bit pixel driving data GD in accordance with a conversion table shown in FIG. 5, and supplies the data GD to a memory 4.

The memory 4 serially writes the pixel driving data GD described above in accordance with a write signal supplied from the driving control circuit 2. The memory 4 executes the following read operation whenever the write operation of (n×m) data of one display screen, that is, the data from the pixel driving data $GD_{11}$ corresponding to the first row/first column to the pixel driving data $GD_{nm}$ corresponding to the nth row/mth column, is completed.

First, the memory 4 grasps the first bit as the lowermost bit of each pixel driving data $GD_{11}$ to $GD_{nm}$ as the pixel driving data bit $DB1_{11}$ to $DB1_{nm}$, reads the pixel driving data bits for one display line and supplies them to an address driver 6. Next, the memory 4 grasps the second bit as the bit of each pixel driving data $GD_{11}$ to $GD_{nm}$ as the pixel driving data bit $DB2_{11}$ to $DB2_{nm}$, reads the pixel driving data bits for one display line and supplies them to the address driver 6.

The memory 4 then grasps the third bit of each pixel driving data $GD_{11}$ to $GD_{nm}$ as the pixel driving data bit $DB3_{11}$ to $DB3_{nm}$, reads the pixel driving data bits for one display line and supplies them to the address driver 6. Further, the memory 4 grasps the fourth bit of each pixel driving data $GD_{11}$ to $GD_{nm}$ as the pixel driving data bit $DB4_{11}$ to $DB4_{nm}$, reads the pixel driving data bits for one display line and supplies them to the address driver 6.

Incidentally, the memory 4 executes the read operation of each pixel driving data bit DB1 to DB4 described above in such a fashion as to correspond to each sub-field SF1 to SF4 of a light emission driving format (to be described later) shown in FIG. 6. The memory 4 executes the read operation of the pixel driving data bit DB1 in the sub-field SF1, the pixel driving data bit DB2 in SF2, the pixel driving data bit DB3 in SF3 and the pixel driving data bit DB4 in SF4.

Figure 6:
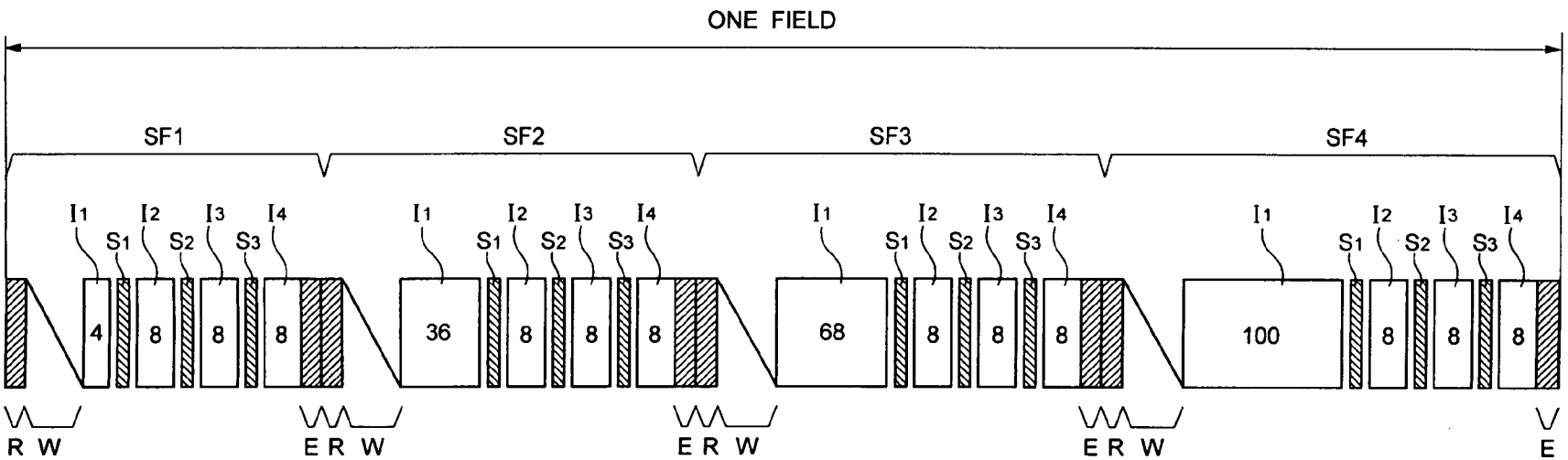
FIG. 6 is a diagram showing an example of a light emission driving format on the basis of a driving method according to the present invention.

The driving control circuit 2 generates various timing signals for driving gradation-wise PDP 10 in accordance with a light emission driving format shown in FIG. 6, and supplies these signals to each of the address driver 6, the first sustain driver 7 and the second sustain driver 8.

Incidentally, in the light emission driving format shown in FIG. 6, a display period of one field (frame) comprises four sub-fields SF1 to SF4 as described above. Inside each sub-field, a simultaneous reset step R, a pixel data write step W, first to fourth light emission sustain steps $I_1$ to $I_4$, first to third selective simultaneous erase steps $S_1$ to $S_3$ and a second erase step E are executed respectively.

Figure 7:
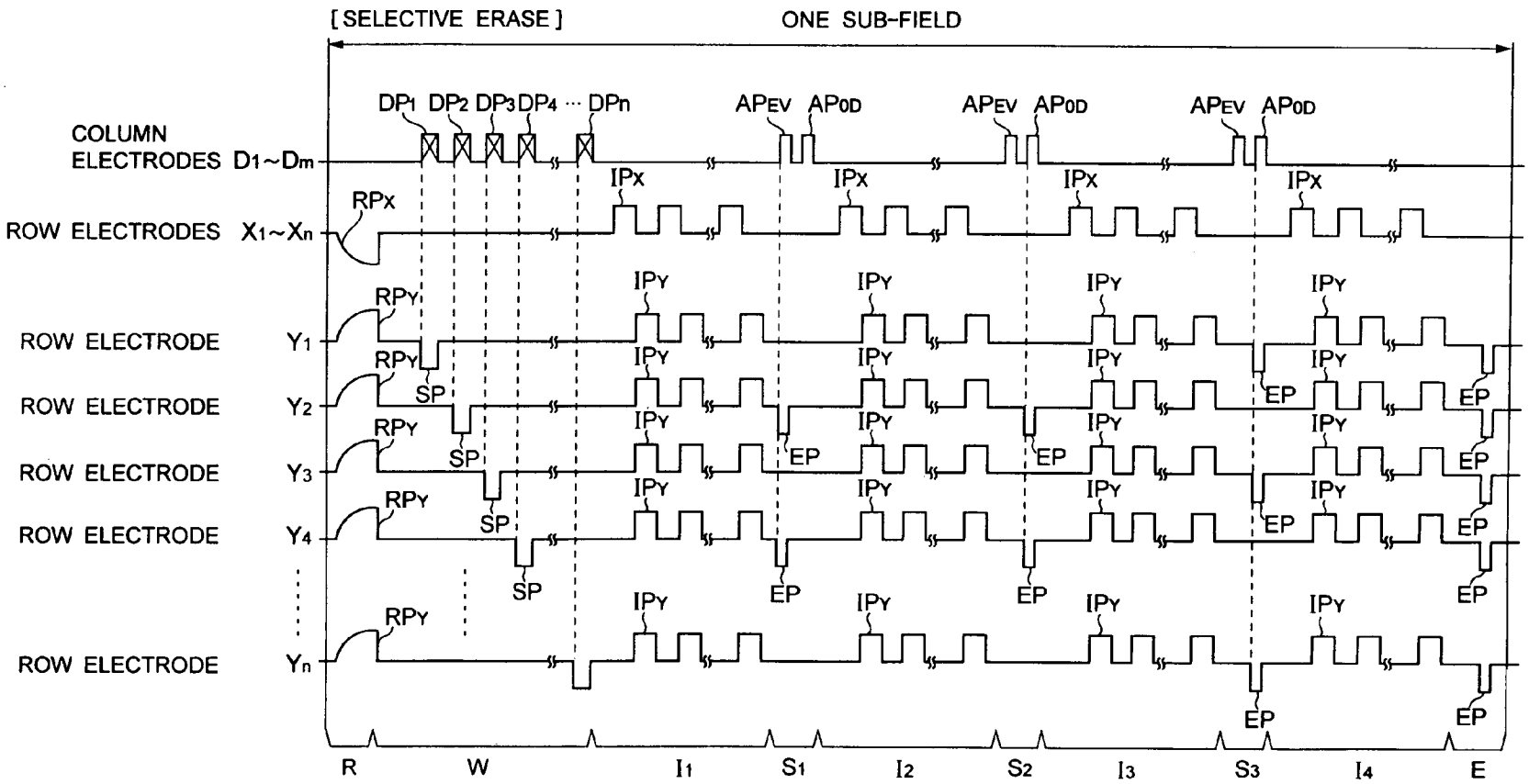
FIG. 7 shows various driving pulses applied to PDP 10 and their application timing when a selective erase address method is employed.

FIG. 7 shows various driving pulses that the address driver 6, the first sustain driver 7 and the second sustain driver 8 apply to the PDP 10 in accordance with various timing signals supplied from the driving control circuit 2, and their application timing.

Referring to FIG. 7, in the simultaneous reset step R to be executed at the leading part of each sub-field, the first sustain driver 7 generates a reset pulse $RP_x$ of a negative polarity and applies the reset pulse to the row electrodes $X_1$ to $X_n$. The second sustain driver 8 generates a reset pulse $RP_y$ of a positive polarity and applies the reset pulse to the row electrodes $Y_1$ to $Y_n$ simultaneously with the application of the reset pulse $RP_x$. Reset discharge is induced inside all the discharge cells of the PDP 10 in response to the simultaneous application of these reset pulses $RP_x$ and $RP_y$, and a wall charge is formed inside each discharge cell. In consequence, all the discharge cells are initialized to a state of "light emission cell".

After such a simultaneous reset step R is completed, the pixel data write step W is executed.

In the pixel data write step W, the address driver 6 generates a pixel data pulse having a pulse voltage corresponding to the pixel driving data bit DB supplied from the memory 4. Since the pixel driving data bit DB1 is supplied from the memory 4 in the sub-field SF1, for example, the address driver 6 generates the pixel data pulse having a pulse voltage corresponding to a logic level of the pixel driving data bit DB1. Since the pixel driving data bit DB2 is supplied from the memory 4 in the sub-field SF2, the address driver 6 generates the pixel data pulse having a pulse voltage corresponding to a logic level of the pixel driving data bit-DB2. Incidentally, the address driver 6 generates the pixel data pulse of a high voltage when the logic level of the pixel driving data bit DB is "1" and a pixel data pulse of a low voltage (0 V) when the logic level is "0". The address driver 6 serially applies the pixel data pulses generated in this way to the column electrodes $D_1$ to $D_m$ as pixel data pulse group $DP_1$ to $DP_n$ that is grouped for each display line, as shown in FIG. 7.

In the pixel data write step W, the second sustain driver 8 generates a scan pulse SP of a negative polarity at the application timing of the pixel data pulse group $DP_1$ to $DP_n$, and serially applies the scan pulse SP to the row electrodes $Y_1$ to $Y_n$ as shown in FIG. 7. Here, discharge (selective erase discharge) occurs in only the discharge cell at the intersection between the display line to which the scan pulse SP is applied and the "column" to which the pixel data pulse of a high voltage is applied. Such selective erase discharge extinguishes the wall charge formed inside the discharge cell, and the discharge cell shifts to the state of "light non-emission cell". On the other hand, the selective erase discharge does not occur in the discharge cells to which the scan pulse SP described above is applied but to which the pixel data pulse of a low voltage is applied. In consequence, these discharge cells maintain the state in which they are initialized by the simultaneous reset step R, that is, the "light emission cell" state. In other words, the pixel data write step W sets each discharge cell either to the "light emission cell" state or the "light non-emission cell" state in accordance with the pixel data based on the input image signal.

After the pixel data write step W is completed, the first light emission sustain step $I_1$ is executed as shown in FIG. 7.

In the first light emission sustain step $I_1$, the first sustain driver 7 and the second sustain driver 8 alternately apply the sustain pulses $IP_x$ and $IP_y$ of the positive polarity to the row electrodes $X_1$ to $X_n$ and $Y_1$ to $Y_n$, respectively, as shown in FIG. 7. In this instance, the number of times (or the period) of the application of the sustain pulse IP repeatedly applied in each first light emission sustain step $I_1$ of each sub-field $SF_1$ to $SF_4$ is given as follows when the number of times in the first light emission sustain step $I_1$ of the sub-field SF1 is 4:

SF1: 4
SF2: 36
SF3: 68
SF4: 100

As a result of the operation described above, only the discharge cells in which the wall charge remains, that is, only the discharge cells which are under the "light emission cell" state, execute sustain discharge whenever the sustain pulses $IP_x$ and $IP_y$ described above are applied, and sustain the light emission state by the sustain discharge the number of times listed above.

After the first light emission sustain step $I_1$ described above is completed, the first selective simultaneous erase step $S_1$ is executed as shown in FIG. 7.

In this first selective simultaneous erase step S1, the address driver 6 applies an even-numbered address pulse $AP_{EV}$ of a positive polarity shown in FIG. 7 to each of the even-numbered column electrodes $D_2, D_4, D_6, D_8, \ldots, D_m$ among the column electrodes $D_1$ to $D_m$. The second sustain driver 8 applies the erase pulse EP of a negative polarity shown in FIG. 7 to each of the even-numbered row electrodes $Y_2, Y_4, Y_6, Y_8, \ldots, Y_n$ among the row electrodes $Y_1$ to $Y_n$ at the same timing as the application timing of the even-numbered address pulse $AP_{EV}$. The simultaneous application of these even-numbered address pulse $AP_{EV}$ and erase pulse EP generate simultaneous erase discharge in all the discharge cells at the intersections between the even-numbered "column electrodes" and the even-numbered "row electrode pairs", so that the wall charge formed inside the discharge cells extinguishes.

In other words, when the first selective simultaneous erase step $S_1$ is executed, all the discharge cells arranged in the even-numbered rows/even-numbered columns are compulsively brought into the "light non-emission" state.

After this first selective simultaneous erase step $S_1$ is completed, the second light emission sustain step $I_2$ is executed as shown in FIG. 7.

In the second light emission sustain step $I_2$, the first sustain driver 7 and the second sustain driver 8 alternatively apply the sustain pulses $IP_x$ and $IP_y$ of a positive polarity shown in FIG. 7 to the row electrodes $X_1$ to $X_n$ and $Y_1$ to $Y_n$. In this case, the number of times (or the period) of the application of the sustain pulse IP to be applied repeatedly inside the second light emission sustain step $I_2$ of each sub-field SF1 to SF4 is 8. As a result of such an operation, only the discharge cells in which the wall charge remains, that is, only the discharge cells under the "light emission cell" state, execute sustain discharge whenever the sustain pulses $IP_x$ and $IP_y$ are applied, and sustain only eight times the light emission state accompanied with the sustain discharge.

After the second light emission sustain step $I_2$ is completed, the second selective simultaneous erase step $S_2$ is executed as shown in FIG. 7.

In this second selective simultaneous erase step $S_2$, the address driver 6 applies an odd-numbered address pulse $AP_{OD}$ of a positive polarity shown in FIG. 7 to each of the odd-numbered column electrodes $D_1, D_3, D_5, D_7 \ldots, D_{m-1}$ among the column electrodes $D_1$ to $D_m$ The second sustain driver 8 applies the erase pulse EP of a negative polarity shown in FIG. 7 to each of the even-numbered row electrodes $Y_2, Y_4, Y_6, Y_8, \ldots, Y_n$ among the row electrodes $Y_1$ to $Y_n$ at the same timing as the application timing of the odd-numbered address pulse $AP_{OD}$. The simultaneous application of these odd-numbered address pulse $AP_{OD}$ and erase pulse EP generate simultaneous erase discharge in all the discharge cells at the intersections between the odd-numbered "column electrodes" and the even-numbered "row electrode pairs", so that the wall charge formed inside the discharge cells extinguishes.

In other words, when the second selective simultaneous erase step $S_2$ is executed, all the discharge cells arranged in the even-numbered rows/odd-numbered columns are compulsively brought into the "light non-emission cell" state.

After this second selective simultaneous erase step $S_2$ is completed, the third light emission sustain step $I_3$ is executed as shown in FIG. 7.

In the third light emission sustain step $I_3$, the first sustain driver 7 and the second sustain driver 8 alternatively apply the sustain pulses $IP_x$ and $IP_y$ of a positive polarity shown in FIG. 7 to the row electrodes $X_1$ to $X_n$ and $Y_1$ to $Y_n$ . In this case, the number of times (or the period) of the application of the sustain pulse IP to be applied repeatedly inside the third light emission sustain step $I_3$ of each sub-field SF1 to SF4 is 8. As a result of such an operation, only the discharge cells in which the wall charge remains, that is, only the discharge cells under the "light emission cell" state, execute sustain discharge whenever the sustain pulses $IP_x$ and $IP_y$ are applied, and sustain only eight times the light emission state accompanied with the sustain discharge.

After the third light emission sustain step $I_3$ is completed, the third selective simultaneous erase step $S_3$ is executed as shown in FIG. 7.

In this third selective simultaneous erase step $S_3$, the address driver 6 applies an odd-numbered address pulse $AP_{OD}$ of a positive polarity shown in FIG. 7 to each of the odd-numbered column electrodes $D_1, D_3, D_5, D_7, \ldots, D_{m-1}$ among the column electrodes $D_1$ to $D_m$. The second sustain driver 8 applies the erase pulse EP of a negative polarity shown in FIG. 7 to each of the odd-numbered row electrodes $Y_1, Y_3, Y_5, Y_7, \ldots, Y_{n-1}$ among the row electrodes $Y_1$ to $Y_n$ at the same timing as the application timing of the odd-numbered address pulse $AP_{OD}$. The simultaneous application of these odd-numbered address pulse $AP_{OD}$ and the erase pulse EP generate simultaneous erase discharge in all the discharge cells at the intersections between the odd-numbered "column electrodes" and the odd-numbered "row electrode pairs", so that the wall charge formed inside the discharge cells extinguishes.

In other words, when the third selection/simultaneous erase step $S_3$ is executed, all the discharge cells arranged in the odd-numbered rows/odd-numbered columns are compulsively brought into the "light non-emission cell" state.

After this third selective simultaneous erase step $S_3$ is completed, the fourth light emission sustain step $I_4$ is executed as shown in FIG. 7.

In the fourth light emission sustain step $I_4$, the first sustain driver 7 and the second sustain driver 8 alternatively apply the sustain pulses $IP_x$, and $IP_y$ of a positive polarity shown in FIG. 7 to the row electrodes $X_1$ to $X_n$ and $Y_1$ to $Y_n$. In this case, the number of times (or the period) of the application of the sustain pulse IP to be applied repeatedly inside the fourth light emission sustain step $I_4$ of each sub-field SF1 to SF4 is 8. As a result of such an operation, only the discharge cells in which the wall charge remains, that is, only the discharge cells under the "light emission cell" state, execute sustain discharge whenever the sustain pulses $IP_x$ and $IP_y$ are applied, and sustain only eight times the light emission state accompanied with the sustain discharge.

After the fourth light emission sustain step 14 is completed, the erase step E is executed as shown in FIG. 7.

In the erase step E, the second sustain driver 8 applies the erase pulse EP of a negative polarity shown in FIG. 7 to all the row electrodes $Y_1$ to $Y_n$. Erase discharge is generated inside one screen in response to such an application operation, and all the discharge cells enter the "light non-emission cell" state.

According to the driving method shown in FIG. 7, only the discharge cells set to the "light emission cell" state in the pixel data write step W keep the light emission state resulting from sustain discharge generated in each of the first to fourth light emission sustain step $I_1$ to $I_4$ in the sum of the number of times corresponding to the number of times of sustain discharge. In the sub-field SF1, for example, sustain discharge is effected 4 times in the first light emission sustain step $I_1$ eight times in the second light emission sustain step $I_2$, 8 times in the third light emission sustain step $I_3$ and 8 times in the fourth light emission sustain step $I_4$, that is, 28 times in all, as shown in FIG. 6. In other words, the number of times of execution of sustain discharge is allotted to each of the sub-fields SF1 to SF4 as listed below:

SF1: 28
SF2: 60
SF3: 92
SF4: 124

In this instance, intermediate luminance corresponding to the sum of the number of times of sustain discharge induced inside each sub-field SF1 to SF4 can be acquired on the screen of the PDP 10.

In the driving method shown in FIGS. 6 and 7, the first selective simultaneous erase step $S_1$ is executed immediately after completion of the first light emission sustain step $I_1$ to compulsively bring all the discharge cells arranged in the even-numbered row/even-numbered column into the "light non-emission cell" state. Further, the second selective simultaneous erase step $S_2$ is executed immediately after completion of the second light emission sustain step $I_2$ to compulsively bring all the discharge cells arranged in the even-numbered row/odd-numbered column into the "light non-emission cell" state. The third selective simultaneous erase step $S_3$ is executed immediately after completion of the third light emission sustain step $I_3$ to compulsively bring all the discharge cells arranged in the odd-numbered row/odd-numbered column into the "light non-emission cell" state.

Figure 8:
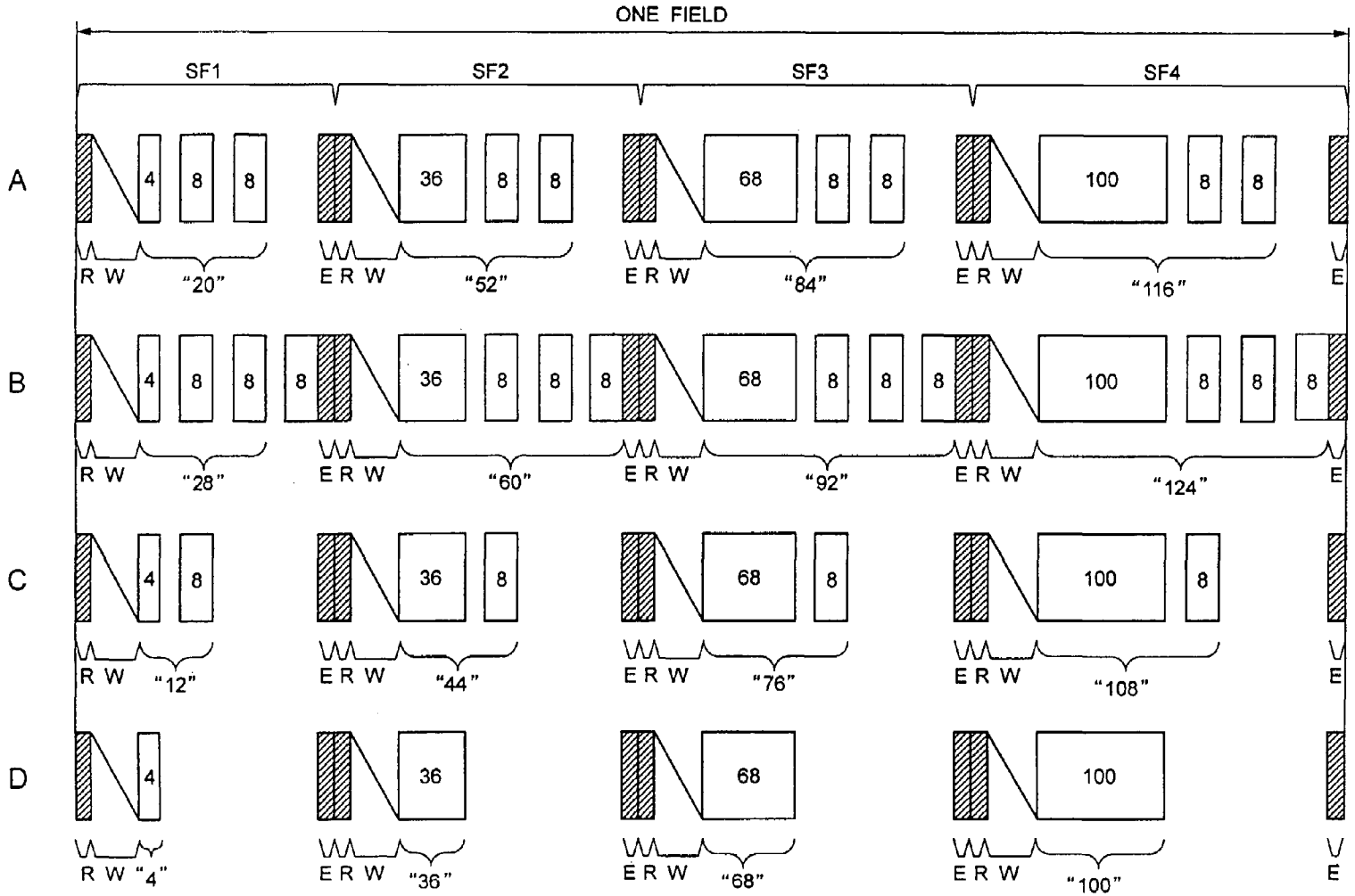
FIG. 8 shows light emission driving formats A to D allocated to discharge cells inside a discharge cell block.

Therefore, the discharge cells arranged in the odd-numbered row/odd-numbered column do not execute sustain discharge in the fourth light emission sustain step $I_4$ even when they are under the "light emission cell" state. In other words, gradation driving is substantially conducted in the discharge cells belonging to the odd-numbered row/odd-numbered column in accordance with the light emission driving format A shown in FIG. 8. In consequence, sustain discharge is effected the number of times in each sub-field SF1 to SF4 as listed below:

SF1: 20
SF2: 52
SF3: 84
SF4: 116

On the other hand, the discharge cells arranged in the odd-numbered row/even-numbered column are not affected by the first selective simultaneous erase step $S_1$ to the third selective simultaneous erase step $S_3$. Therefore, gradation driving is substantially conducted in these discharge cells in accordance with the light emission driving format B shown in FIG. 8. In consequence, sustain discharge is effected the number of times in each sub-field SF1 to SF4 as listed below:

SF1: 28
SF2: 60
SF3: 92
SF4: 124

The discharge cells arranged in the even-numbered row/odd-numbered column are, however, compulsively brought into the "light non-emission cell" state at the stage of the second selective simultaneous erase step $S_2$. Therefore, these discharge cells do not execute sustain discharge in the third light emission sustain step $I_3$ and the fourth light emission sustain step $I_4$. In other words, gradation driving is substantially executed in the discharge cells arranged in the even-numbered row/odd-numbered column in accordance with the light emission driving format C shown in FIG. 8. In consequence, sustain discharge is effected the number of times in each sub-field SF1 to SF4 as listed below:

SF1: 12
SF2: 44
SF3: 76
SF4: 108

Further, the discharge cells arranged in the even-numbered row/even-numbered column are compulsively brought into the "light non-emission cell" state at the stage of the first selective simultaneous erase step $S_1$. Therefore, they do not execute the sustain discharge in each of the second light emission sustain step $I_2$ to the fourth light emission sustain step $I_4$. In other words, gradation driving is substantially executed in the discharge cells arranged in the even-numbered row/even-numbered column in accordance with the light emission driving format D shown in FIG. 8. In consequence, sustain discharge is effected the number of times in each sub-field SF1 to SF4 as listed below:

SF1: 4
SF2: 36
SF3: 68
SF4: 100

Whether each discharge cell is brought into the "light emission cell" state or the "light non-emission cell" state inside each sub-field depends on the pixel driving data GD consisting of four bits and five patterns shown in FIG. 5. In other words, when the bits of the pixel driving data GD are at the logic level "1", selective erase discharge is induced in the sub-field corresponding to the bit digit as represented by the black circles in FIG. 5, and the discharge cells are brought into the "light non-emission cell" state. On the other hand, when the bits of the pixel driving data GD are at the logic level "0", selective erase discharge is not generated. Therefore, the discharge cells are brought into the "light emission cell" state, and sustain discharge is induced in the sub-field corresponding to the bit digit as represented by the white circles.

Therefore, light emission of five gradations having respectively the following luminance levels is executed by the driving operation in the discharge cells arranged in the odd-numbered row/odd-numbered column among the discharge cells arranged in matrix as shown in FIG. 9 on the basis of the light emission driving format A using the pixel driving data GD described above:

[0, 20, 72, 156, 2721]

Figure 4B:
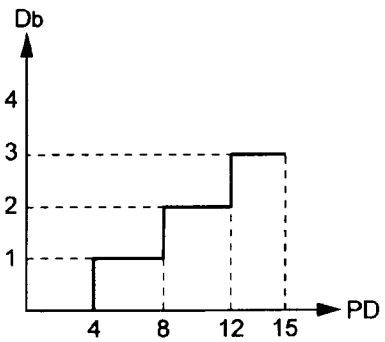
Figure 4C:
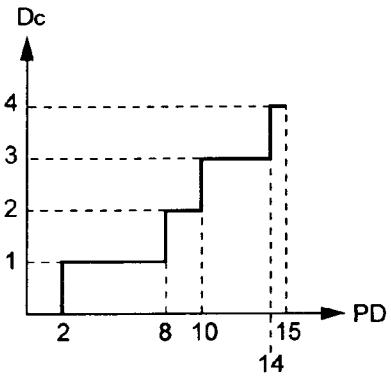
Figure 4D:
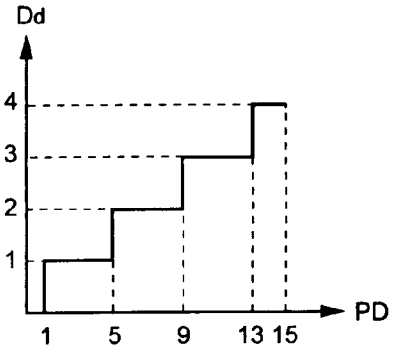

In the discharge cells arranged in the odd-numbered/even-numbered column, light emission of four gradations having respectively the following luminance levels is executed by the driving operation on the basis of the light emission driving format B using the pixel driving data GD (with the proviso that GD "0000" does not exist because luminance suppression is made by the second conversion table shown in FIG. 4B):

[0, 28, 88, 180]

In the discharge cells arranged in the even-numbered row/odd-numbered column, light emission of five gradations having respectively the following luminance levels is executed by the driving operation on the basis of the light emission driving format C:

[0, 12, 56, 132, 240]

In the discharge cells arranged in the even-numbered row/even-numbered column, light emission of five gradations having respectively the following luminance levels is executed on the basis of the light emission driving format D:

[0, 4, 40, 108, 208]

Figures 10A, 10B, 10C, 10D:
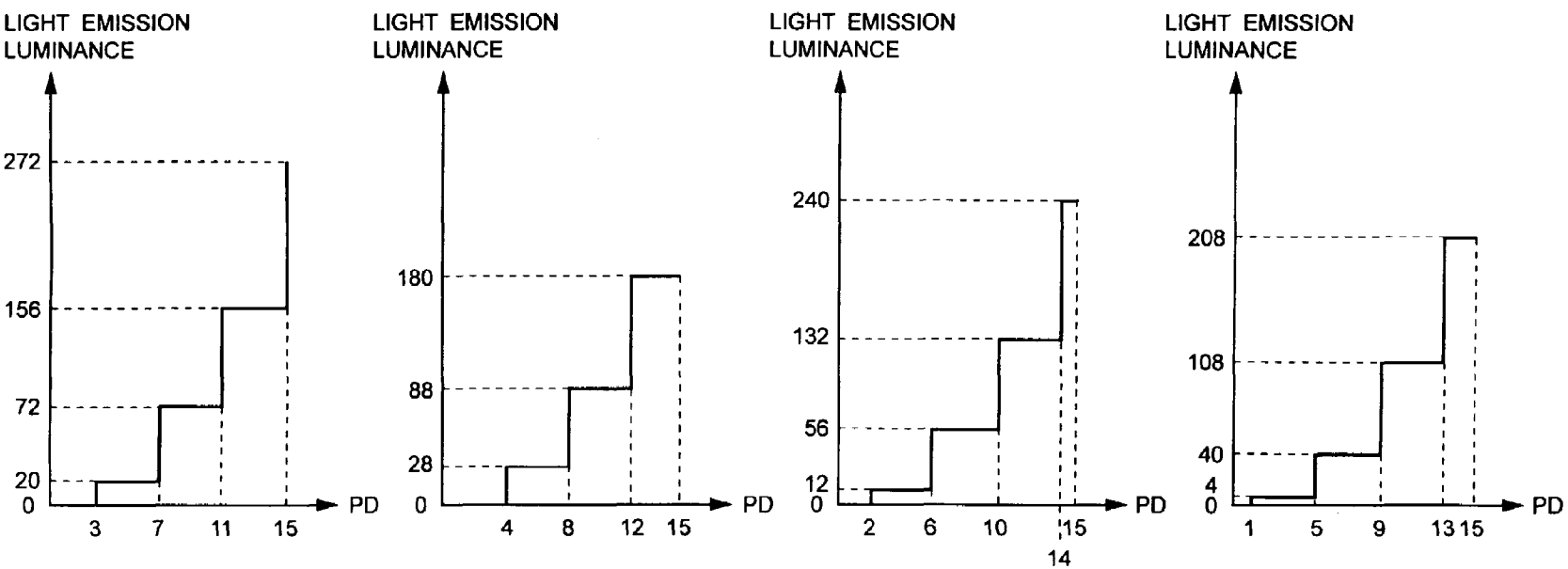
FIGS. 10A through 10D are diagrams showing light emission luminance acquired for pixel data PD for each light emission driving format A to D.

As a result, in the discharge cells arranged in the odd-numbered row/odd-numbered column, light emission of the luminance level shown in FIG. 10A is executed in accordance with the pixel data PD. In the discharge cells arranged in the odd-numbered row/even-numbered column, light emission of the luminance level shown in FIG. 10B is executed in accordance with the pixel data PD. In the discharge cells arranged in the even-numbered row/odd-numbered column, light emission of the luminance level shown in FIG. 10C is executed in accordance with the pixel data PD. Further, in the discharge cells arranged in the even-numbered row/even-numbered column, light emission of the luminance level shown in FIG. 10D is executed in accordance with the pixel data PD.

In other words, the number of light emissions (the number of times of sustain discharge) to be executed in each sub-field is executed as mutually different light emission driving formats A to D are allotted respectively thereto for each of the four discharge cells inside the discharge cell blocks encompassed by thick lines in FIG. 9.

Figure 11:
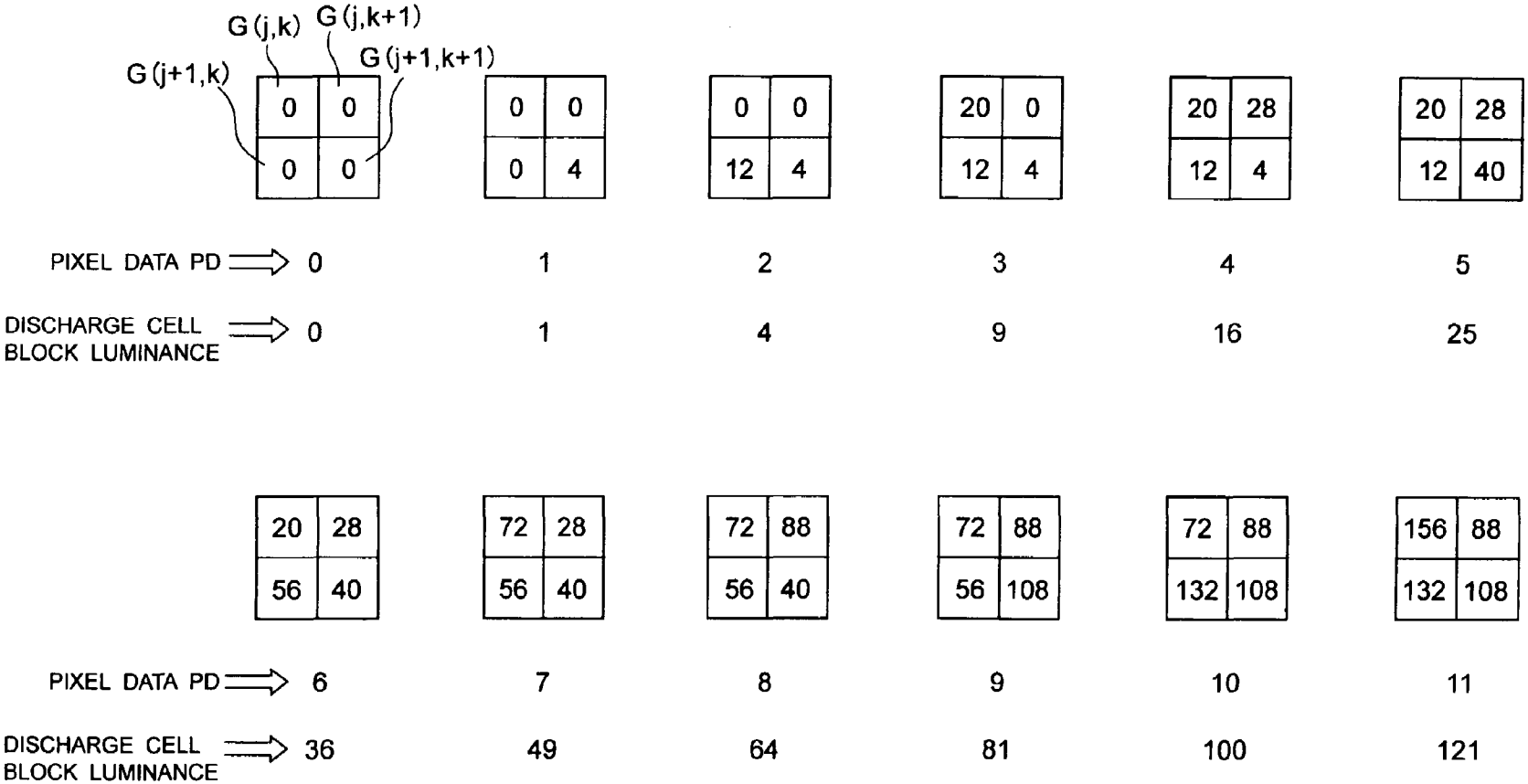
FIG. 11 a diagram showing pixel data PD corresponding to each luminance level "0" to "11" and light emission luminance of each discharge cell inside a discharge cell block.

Therefore, when the same pixel data is supplied to each of the four discharge cells inside the discharge cell block, the light emission luminance level inside this discharge cell block becomes such as the state shown in FIG. 11.

When the pixel data PD representative of the luminance level "4" is supplied, for example, the discharge cell G(j, k) arranged in the odd-numbered row/odd-numbered column emits light of the luminance level "20" as shown in FIG. 11. In this case, the discharge cell G(j, k+1) arranged in the odd-numbered row/even-numbered column emits light of the luminance level "28". The discharge cell G(j+1, k) arranged in the even-numbered row/odd-numbered column emits light of the luminance level 12. Further, the discharge cell G(j+1, k+1) arranged in the even-numbered row/even-numbered column emits light of the luminance level "4". In consequence, the mean luminance level of each discharge cell is "16", and this is the light emission luminance level that is visually sensed in the discharge cell block unit consisting of the four discharge cells.

When the pixel data PD representative of the luminance level "10" is supplied, for example, the discharge cell G(j, k) arranged in the odd-numbered row/odd-numbered column emits light of the luminance level "72" as shown in FIG. 11. In this case, the discharge cell G(j, k+1) arranged in the odd-numbered row/even-numbered column emits light of the luminance level "88". The discharge cell G(j+1, k) arranged in the even-numbered row/odd-numbered column emits light of the luminance level "132". Further, the discharge cell G(j+1, k+1) arranged in the even-numbered row/even-numbered column emits light of the luminance level "108". In consequence, the mean luminance level of each discharge cell is "100", and this is the light emission luminance level that is visually sensed in the discharge cell block unit consisting of the four discharge cells.

Figure 12:
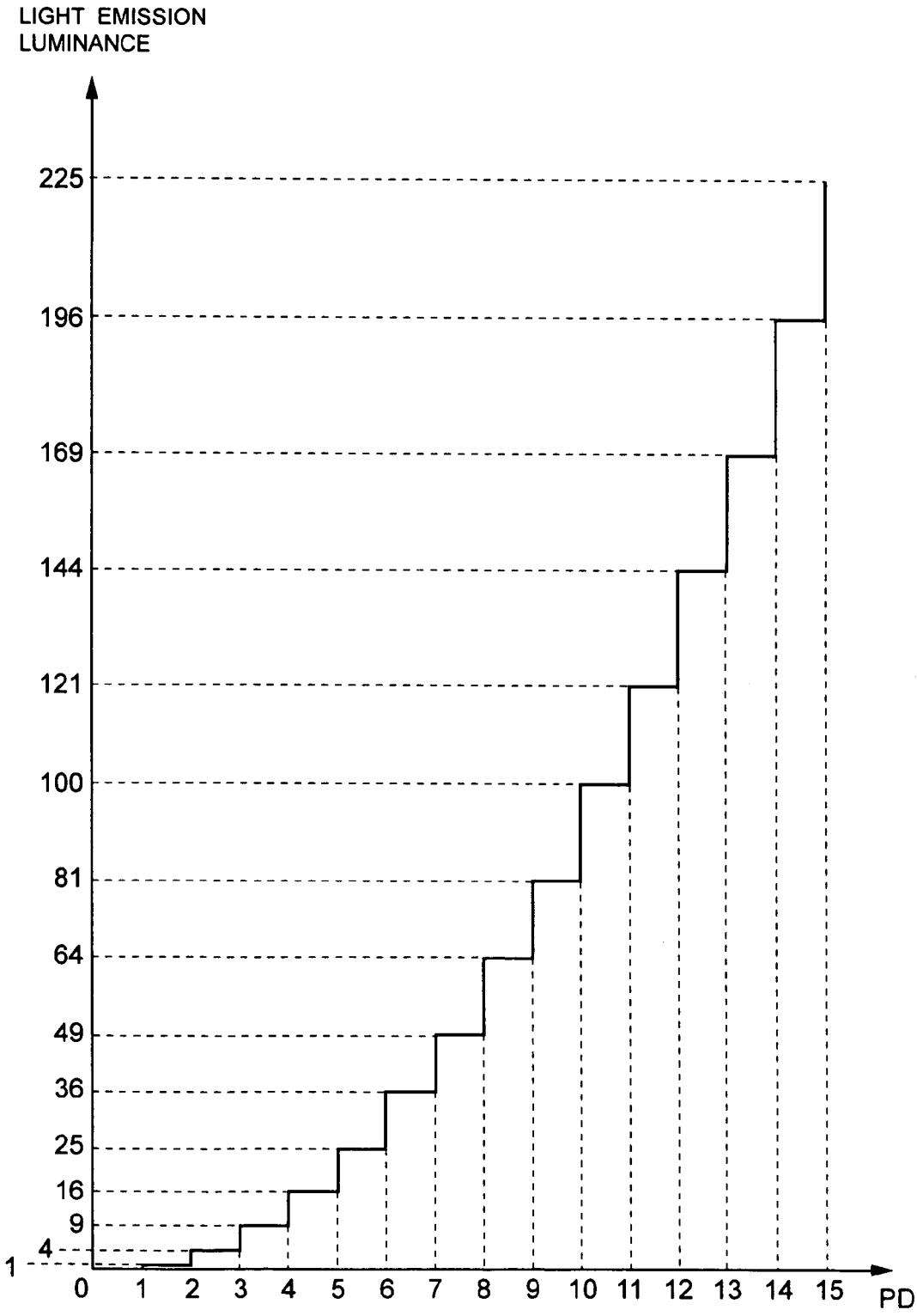
FIG. 12 is a diagram showing the correspondence between pixel data PD and a light emission luminance level visually sensed in a discharge cell block unit.

FIG. 12 is a graph showing the relation between the pixel data PD corresponding to the input image signal and the light emission luminance level visually sensed in the discharge cell block unit consisting of the four discharge cells.

Even though the number of gradations during driving for one discharge cell is five gradations as shown in FIG. 5, intermediate luminance of sixteen gradations can be visually sensed as shown in FIG. 12 when the adjacent four discharge cells are grasped as one display unit. In other words, the driving method described above executes a multi-gradation processing analogous to a dither processing without adding a dither coefficient to the original pixel data.

Therefore, the present invention can keep the luminance difference among the discharge cells inside all the discharge cell blocks constant, and can accomplish multi-gradation having high display quality.

Incidentally, in the embodiment given above, driving is executed by allotting the light emission driving format to each of the four discharge cells in the following way as shown in FIG. 9:

Discharge cells arranged in odd-numbered row/odd-numbered column: light emission driving format A Discharge cells arranged in odd-numbered row/even-numbered discharge cells: light emission driving format B Discharge cells arranged in even-numbered row/odd-numbered column: light emission driving format C Discharge cells arranged in even-numbered row/even-numbered column: light emission driving format D However, allotment of the light emission driving format to each discharge cell is not limited to the allotment described above.

Figure 13:
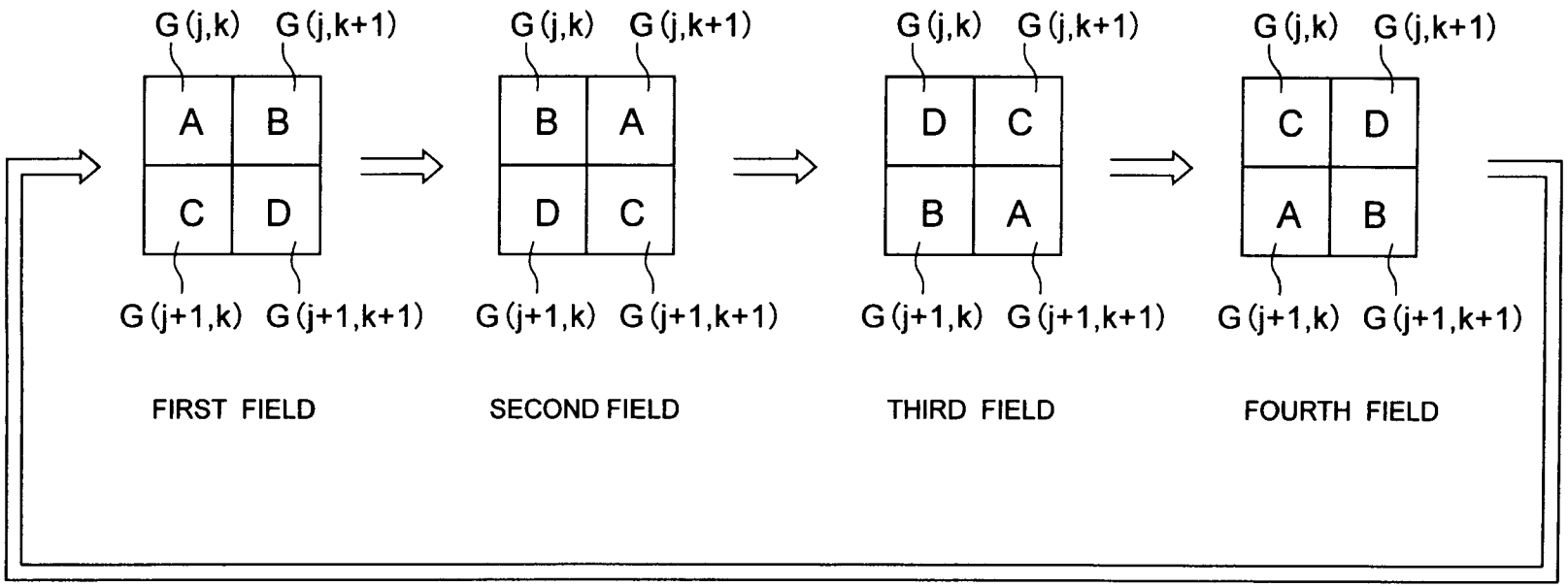
FIG. 13 is a diagram showing an operation example when allotment of a light emission driving format A to D for each discharge cell is changed in each one-field display period.

The allotment of each light emission driving format A to D to each of the four discharge cells may be changed in each one-field display period as shown in FIG. 13.

In the first field, the allotment is as follows:

Discharge cell G(j,k) arranged in odd-numbered row/odd-numbered column: Light emission driving format A Discharge cell G(j,k+1) arranged in odd-numbered row/even-numbered column: Light emission driving format B Discharge cell G(j+1, k) arranged in even-numbered row/odd-numbered column: Light emission driving format C Discharge cell G(j+1,k+1) arranged in even-numbered row/even-numbered column: Light emission driving format D In the second field:

Discharge cell G(j,k) arranged in odd-numbered row/odd-numbered column: Light emission driving format B Discharge cell G(j,k+1) arranged in odd-numbered row/even-numbered column: Light emission driving format A Discharge cell G(j+1, k) arranged in even-numbered row/odd-numbered column: Light emission driving format D Discharge cell G(j+1,k+1) arranged in even-numbered row/even-numbered column: Light emission driving format C In the next third field:

Discharge cell G(j, k) arranged in odd-numbered row/odd-numbered column: Light emission driving format D Discharge cell G(j,k+1) arranged in odd-numbered row/even-numbered column: Light emission driving format C Discharge cell G(j+1, k) arranged in even-numbered row/odd-numbered column: Light emission driving format B Discharge cell G(j+1,k+1) arranged in even-numbered row/even-numbered column: Light emission driving format A In the fourth field:

Discharge cell G(j, k) arranged in odd-numbered row/odd-numbered column: Light emission driving format C Discharge cell G(j,k+1) arranged in odd-numbered row/even-numbered column: Light emission driving format D Discharge cell G(j+1, k) arranged in even-numbered row/odd-numbered column: Light emission driving format A Discharge cell G(j+1,k+1) arranged in even-numbered row/even-numbered column: Light emission driving format B The operation in each of the first to fourth fields described above is repeatedly executed.

The embodiment given above employs a so-called "selective erase address method" that the discharge cells are selectively discharged (selective erase discharge) in accordance with the pixel data and the wall charge is extinguished to write the pixel data, as the write method of the pixel data. However, the present invention can be similarly applied to a so-called "selective write address method" that the discharge cells are selectively discharged (selective write discharge) in accordance with the pixel data and the wall charge is generated inside the discharge cells, as the write method of the pixel data.

Figure 14:
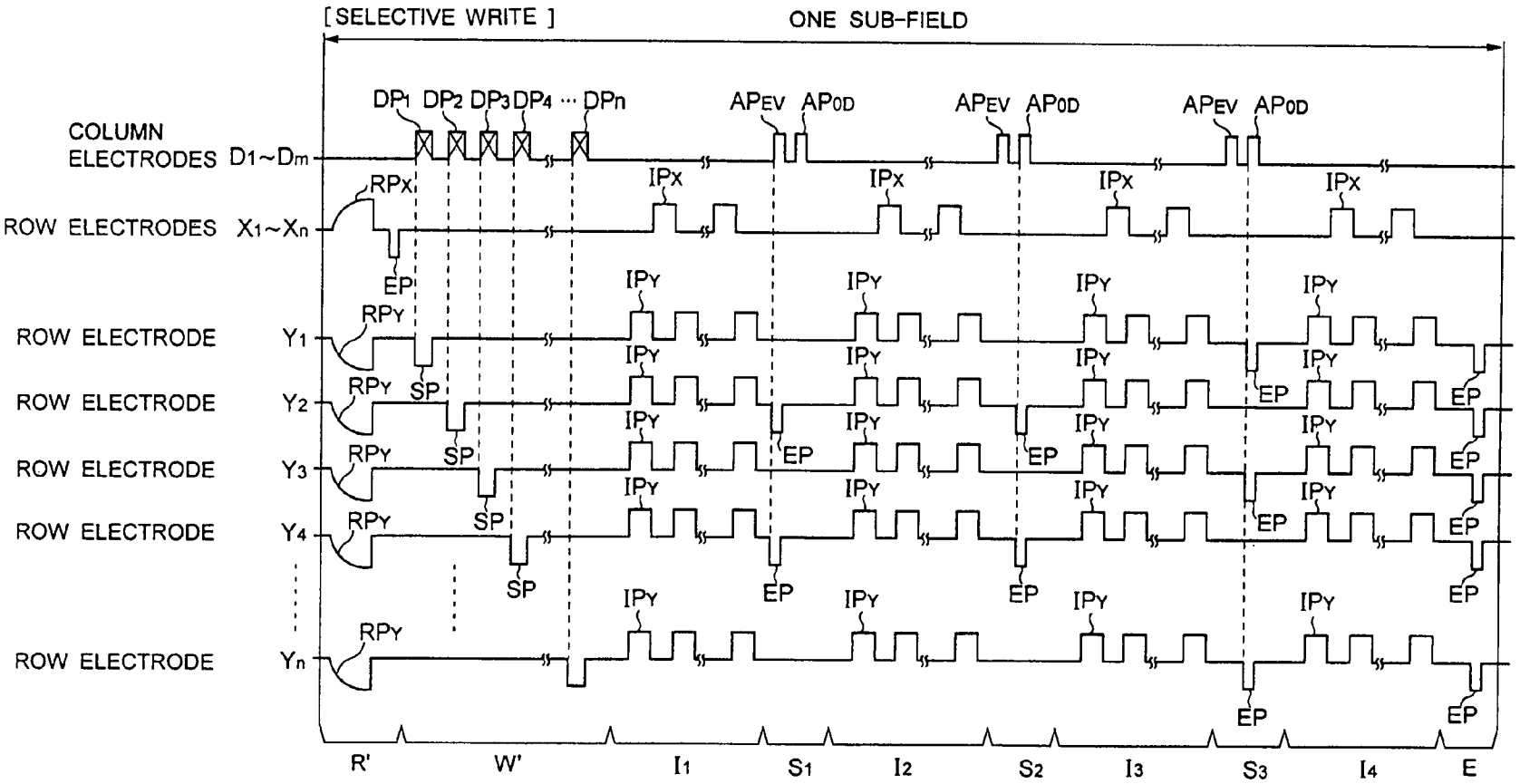
FIG. 14 is a diagram showing various driving pulses applied to PDP 10 and their application timing when a selective write address method is employed.

FIG. 14 shows the driving pulses that the address driver 6, the first sustain driver 7 and the second sustain driver 8 apply to the PDP 10 and their application timing when the selective write address method is employed.

Incidentally, the operation contents of all the steps other than the simultaneous reset step R' and the pixel data write step W', that is, the first light emission sustain step $I_1$ to the fourth light emission sustain step $I_4$, the first selective simultaneous erase step $S_1$ to the third selective simultaneous erase step $S_3$ and the erase step E in FIG. 14 are the same as those shown in FIG. 7. Therefore, their explanation will be omitted.

In the simultaneous reset step R' executed at the leading part of each sub-field shown in FIG. 14, the first sustain driver 7 applies simultaneously the reset pulse $RP_x$ of a positive polarity to all the row electrodes $X_1$ to $X_n$ of the PDP 10. At the same time, the second sustain driver 8 applies the reset pulse $RP_y$ of a negative polarity to all the row electrodes $Y_1$ to $Y_n$. All the discharge cells inside the PDP 10 are subjected to the reset discharge in response to the application of these reset pulses $RP_x$ and $RP_y$ and a wall charge of a predetermined amount is generated uniformly in each discharge cell. Immediately thereafter, the first sustain driver 7 generates the erase pulse EP of a negative polarity as shown in FIG. 14 and applies the erase pulse EP all at once to the row electrodes $X_1$ to $X_n$. The application of such an erase pulse EP generates the erase discharge, and the wall charge that has been formed inside all the discharge cells extinguishes. In other words, according to the simultaneous reset step R' in the selective write address method, all the discharge cells in the PDP 10 are initialized to the "light non-emission cell" state.

In the next pixel data write step W', the address driver 6 generates the pixel data pulse having a pulse voltage corresponding to the pixel driving data bit DB supplied from the memory 4. In the sub-field SF1, for example, the memory 4 supplies the pixel driving data bit DB1. Therefore, the address driver 6 generates a pixel data pulse having a pulse voltage corresponding to the logic level of this pixel driving data bit DB1. In the sub-field SF2, the memory 4 supplies the pixel driving data bit DB2. Therefore, the address driver 6 generates a pixel data pulse having a pulse voltage corresponding to the logic level of this pixel driving data bit DB2. Incidentally, the address driver 6 generates a pixel data pulse having a high voltage when the logic level of the pixel driving data bit DB is "1" and a pixel data pulse having a low voltage (0 V) when the logic level is "0". The address driver 6 groups the pixel data pulses so generated into the form of pixel data pulse groups $DP_1$ to $DP_n$ for each display line and serially applies them to the column electrodes $D_1$ to $D_m$ as shown in FIG. 14.

In the pixel data write step W, the second sustain driver 8 generates the scan pulse SP of a negative polarity at the application timing of each of the pixel data pulse group $DP_1$ to $DP_n$, and serially applies them to all the row electrodes $Y_1$ to $Y_n$ as shown in FIG. 14. Here, discharge (selective write discharge) occurs in only the discharge cells at the intersections between the display lines to which the scan pulse SP is applied and the column to which the pixel data pulse of a high voltage is applied. After such selective write discharge is terminated, the wall charge is generated inside the discharge cells and these discharge cells shift to the "light emission cell" state. On the other hand, such selective write discharge does not occur in the discharge cells to which the scan pulse SP is applied but the pixel data pulse of a low voltage is applied. These discharge cells sustain the state initialized by the simultaneous reset step R', that is, the "light non-emission cell" state. In other words, this pixel data write step W' sets each discharge cell to either the "light emission cell" state or the "light non-emission cell" state in accordance with the pixel data based on the input image signal.

When the selective write address method described above is employed, the second data conversion circuit 34 uses the conversion table shown in FIG. 15 in place of the conversion table shown in FIG. 5 and converts the luminance suppression pixel data $PD_L$ to the pixel driving data GD. Consequently, in the sub-field SF corresponding to the bit digit which is at the logic level "1" among the pixel driving data GD (represented by double-circle in FIG. 15), selective write discharge and sustain discharge described above are generated.

Therefore, when the selective write address method is employed as the pixel data write method, too, similarly to the case in which the selective erase address method is employed, the discharge cells arranged in the odd-numbered row/odd-numbered column execute light emission of the five gradations having respectively the following luminance levels by the driving operation based on the light emission driving format A using the pixel driving data GD described above:

[0, 20, 72, 156, 272]

In the discharge cells arranged in the odd-numbered row/even-numbered column, light emission of four gradations having respectively the following luminance levels is executed by the driving operation based on the light emission driving format B:

[0, 28, 88, 180]

In the discharge cells arranged in the even-numbered row/odd-numbered column, light emission of five gradations having respectively the following luminance levels is executed by the driving operation based on the light emission driving format C:

[0, 12, 56, 132, 2401]

In the discharge cells arranged in the even-numbered row/even-numbered column, light emission of five gradations having respectively the following luminance levels is executed by the driving operation based on the light emission driving format D:

[0, 4, 40, 108, 208]

As described above in detail, when only the discharge cells set to the light emission cell state in accordance with the input image signals are allowed to emit light the number of light emissions allotted in accordance with weighting of the sub-fields, the present invention renders the number of light emissions to be allotted different for each discharge cell inside the discharge cell block. Consequently, multi-gradation display equivalent to the dither processing can be accomplished without adding dither coefficients having mutually different values to the pixel data corresponding to each discharge cell inside the discharge cell block.

According to the present invention, the luminance difference becomes constant among the discharge cells inside all the discharge cell blocks, and an excellent dither processing can be executed without lowering display quality.

This application is based on Japanese Patent Application No. 2000-186530 which is hereby incorporated by reference.

What is claimed is:

1. A driving method of a plasma display panel for driving gradation-wise a plasma display panel having a plurality of discharge cells each arranged in matrix and bearing a role of a pixel by constituting one field of input image signal by a plurality of sub-fields, comprising:

setting each of said discharge cells to one of a light emission cell state and a light non-emission state in accordance with respective pixel data of said input image signal in each of sub-fields; and causing only said discharge cell under said light emission cell state to emit light a number of light emissions allotted in accordance with weighting of said sub-field, wherein adjacent ones of said plurality of discharge cells constitute a discharge cell block and each of said adjacent ones of said plurality of discharge cells is separately driven according to said respective pixel data of said input image signal, and for at least one of said subfields the number of light emissions to be allotted respectively to said discharge cells inside said discharge cell block are rendered different, and are varied for each field, and wherein for discharge cells in the discharge cell block, weighting of said sub-fields are set to satisfy a condition:

$$SFa1<SFb1<SFa2<SFb2< \ldots <SFan<SFbn$$

where SFa1, SFa2 . . . SFan represent weightings. in an ascending order, of said sub-fields for one discharge cell in said discharge cell block and SFb1, SFb2, . . . SFbn represent weightings, in an ascending order, of said sub-fields for another discharge cell in said discharge cell block.

2. The driving method of a plasma display panel according to claim 1, wherein said number of light emissions to be allotted respectively to said discharge cells inside said discharge cell block are varied for each field for all the subfields together constituting one field.

3. A driving method of a plasma display panel for driving gradation-wise a plasma display panel having a plurality of discharge cells each arranged in matrix and bearing a role of a pixel by constituting one field of input image signal by a plurality of sub-fields, wherein adjacent ones of said plurality of discharge cells constitute a discharge cell block and each of said adjacent ones of said plurality of discharge cells is separately driven according to respective pixel data of said input image signal, comprising the following steps serially conducted in each of said sub-fields:

a pixel data write step for setting each of said discharge cells to one of a light emission cell state and a light non-emission cell state in accordance with respective pixel data of said input image signal;

a first light emission sustain step for causing only said discharge cell under said light emission cell state among said discharge cells to emit light the number of light emissions corresponding to weighting of said sub-field;

a first selective erase step for compulsively bringing only said discharge cell positioned at a first position inside said discharge cell block consisting of four of said discharge cells adjacent to one another into said light non-emission cell state;

a second light emission sustain step for causing said discharge cells under said light emission cell state among said discharge cells to emit light a predetermined number of times;

a second selective erase step for compulsively bringing only said discharge cell positioned at a second position inside said discharge cell block into said light non-emission cell state;

a third light emission sustain step for causing only said discharge cells under said light emission state among said discharge cells to emit light at a predetermined number of times;

a third selective erase step for compulsively bringing only said discharge cell arranged at a third position inside said discharge cell block into said light non-emission cell state; and a fourth light emission sustain step for causing only said discharge cells under said light emission cell state among said discharge cells to emit light a predetermined number of times, wherein said number of light emissions to be allotted to each of said discharge cells inside said discharge cell block is varied for each field, and wherein for discharge cells in the discharge cell block, weighting of said sub-fields are set to satisfy a condition:

$$SFa1<SFb1<SFa2<SFb2< \ldots <SFan<SFbn$$

where SFa1, SFa2. . . SFan represent weightings, in an ascending order, of said sub-fields for one discharge cell in said discharge cell block and SFb1, SFb2. . . SFbn represent weightings, in an ascending order, of said sub-fields for another discharge cell in said discharge cell block.

* * * * *